United States Patent [19]

Hillberg

[11] 4,400,901

[45] Aug. 30, 1983

[54] FIREARM HAVING INERTIALLY RESPONSIVE SAFETY MECHANISM

[75] Inventor: Robert L. Hillberg, Cheshire, Conn.

[73] Assignee: COP, Inc., Torrance, Calif.

[21] Appl. No.: 290,154

[22] Filed: Aug. 5, 1981

[51] Int. Cl.[3] ..... F41C 17/00

[52] U.S. Cl. ..... 42/70 F

[58] Field of Search ..... 42/70 F, 70 R, 69 R; 89/154, 131

[56] References Cited

U.S. PATENT DOCUMENTS 3,537,203 11/1970 Weatherby et al. ..... 42/42 R 3,707,796 1/1973 Bielfeldt ..... 42/70 R 3,724,325 4/1973 Silsby ..... 89/131

*Primary Examiner*—Charles T. Jordan

*Assistant Examiner*—Ted L. Parr

*Attorney, Agent, or Firm*—McCormick, Paulding & Huber

[57] ABSTRACT

A four barrel, breech loaded pistol having a double acting firing mechanism includes an inertia responsive pendulum-like safety which swings into blocking relation to the hammer to arrest hammer movement in response to a suddenly arrested rearward motion of the pistol.

14 Claims, 8 Drawing Figures

FIREARM HAVING INERTIALLY RESPONSIVE SAFETY MECHANISM

BACKGROUND OF THE INVENTION

This invention relates in general to firearms and deals more particularly with an improved safety mechanism for a handgun which prevents accidental discharge of the gun. The mechanism of the present invention is particularly adapted for a multi-shot handgun of a double action type, that is a handgun wherein a single pull of a trigger raises a hammer, moves the hammer to a tripping position in opposition to the biasing force of a mainspring, and releases the hammer in its tripping position to move freely to its firing position in response to potential energy stored within the mainspring. After each shot is fired the hammer comes to rest in its firing position adjacent the breech from which position it must be raised to fire the next round. The trigger must be released after each round is fired to reset the firing mechanism to fire the next round.

When a gun of the aforedescribed general type is subjected to unusual shock, as, for example, an unusually great recoil resulting from an excessive propellant charge or loading density, hammer inertia may be sufficiently great to cause movement of the hammer toward its tripping position and through a distance sufficient to reset the mechanism and store enough energy in the mainspring to return the hammer to its firing position with sufficient force to fire the next round. The present invention is concerned with this problem.

SUMMARY OF THE INVENTION

The invention resides in an improved safety mechanism for a handgun having a firing mechanism which includes a trigger movable between ready and firing positions and a first member supported for movement in one and an opposite direction between first and second positions and which is movable in one direction in response to movement of the trigger from its ready position to its firing position. The safety mechanism comprises a blocking element, means supporting the blocking element for movement between active and inactive positions, and inertia responsive means for moving the blocking element from its inactive to its active position. In its active position the blocking element is disposed in blocking relation to the first member and prevents movement of the first member from its first to its second position.

DETAILED DESCRIPTION OF PREFERRED EMBODIMENT

Figure 1:
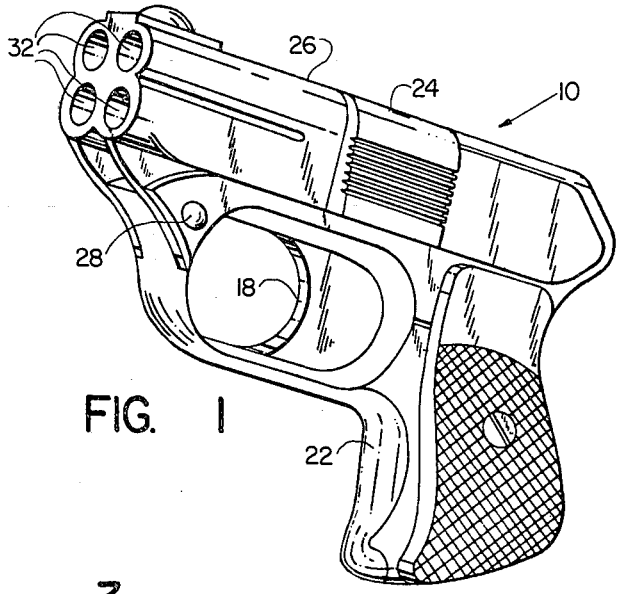
FIG. 1 is a perspective view of a multi-barrel handgun embodying the present invention.

Referring now to the drawings and considering first FIGS. 1–4, a multi-barrel, breech loaded handgun or pistol embodying the present invention is indicated generally by the reference numeral 10. The illustrated pistol 10 has a firing mechanism of double action type which includes a hammer assembly, indicated generally at 14, supported for movement between firing and tripping positions, respectively indicated by full and broken lines in FIG. 2. The firing mechanism further includes a mainspring 16, which normally biases the hammer assembly 14 toward and retains it in its striking position, and a trigger 18 supported for movement between ready and firing positions. A single pull on the trigger 18 moves the hammer assembly to and releases it in its tripping position to freely return to its striking position in response to the biasing force of the mainspring 16. Further, and in accordance with the invention, the pistol 10 includes an inertia responsive safety mechanism, indicated generally at 20, which is operative to block the firing mechanism whereby to prevent double firing or accidental discharge of the pistol 10 in response to inertia developed by parts of the firing mechanism, as will be hereinafter more fully discussed.

Figure 2:
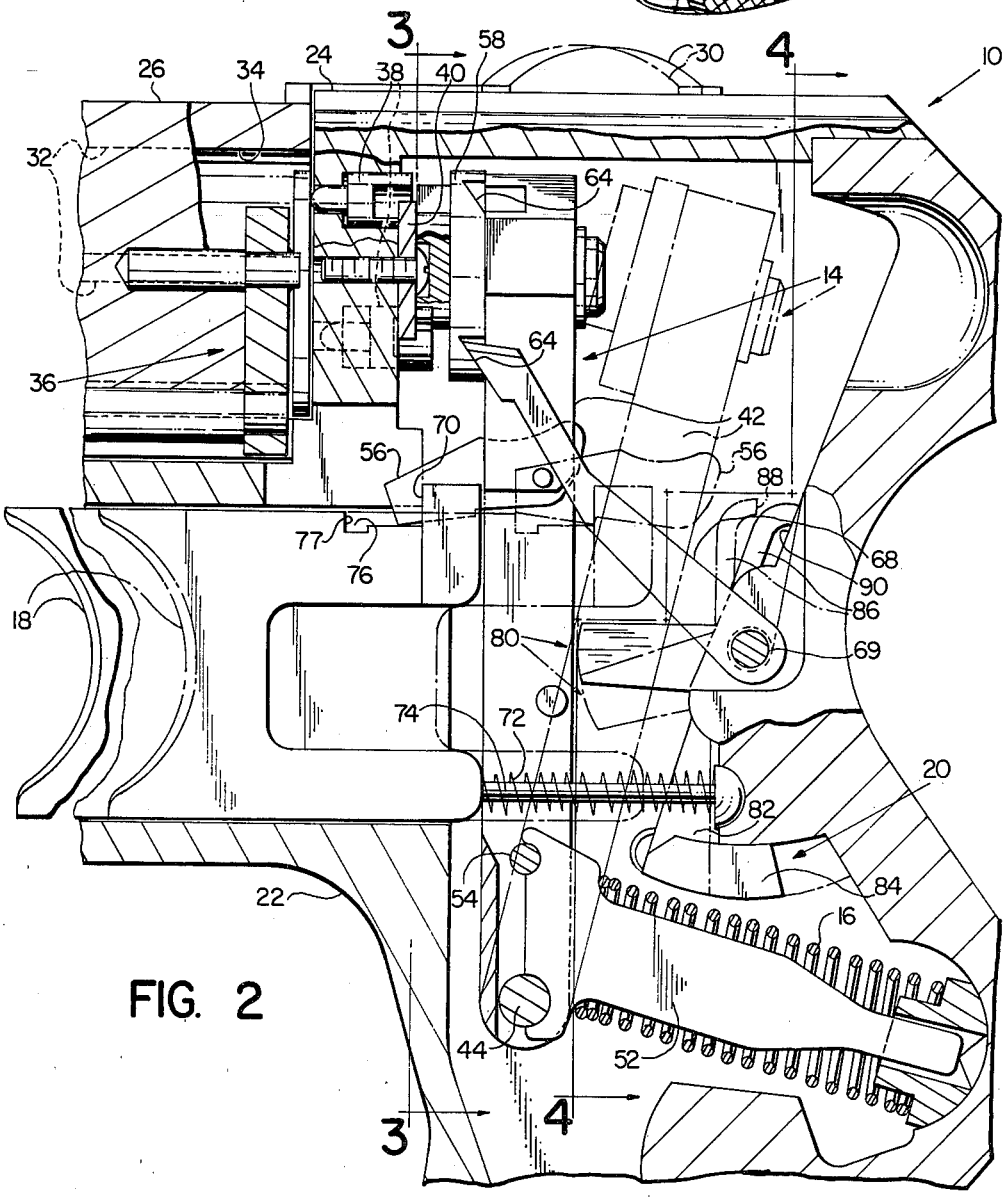
FIG. 2 is a somewhat enlarged fragmentary longitudinal sectional view through the gun of FIG. 1.

Considering now the pistol 10 in further detail, it has a frame 22 which includes a breech portion 24. A barrel assembly 26 is pivotally supported at the forward end of the frame 22 by a hinge pin 28 to break upwardly and away from the breech portion 24 upon rearward movement of a releasing latch, indicated at 30 and associated with the pistol rear sight. The barrel assembly 26 has four integral barrels, as best shown in FIG. 1. Each barrel has a bore 32 which includes a chamber 34 at its breech end. The chambers 34, 34 are closed by the breech portion 24 when the barrel assembly is latched in its closed position relative to the frame by the latch 30, as shown in FIGS. 1 and 2. An extractor mechanism indicated generally at 36, which comprises a part of the barrel assembly 26, operates in a manner well known in the art to extract spent cartridges from the chambers 34, 34 when the barrel assembly 20 is broken upwardly and away from the breech to a substantially fully opened position relative to the frame 22.

The illustrated pistol 10 is arranged for center fire and has four inertia firing pins 38, 38 received within associated bores in the breech portion and retained for limited sliding movement therein by a retaining washer 40 which engages a rearwardly facing shoulder on each firing pin. Each firing pin 38 has a forwardly projecting nose coaxially aligned with an associated chamber 34 and is adapted for striking engagement with the primer of a chambered round. The firing pins are dimensioned so that the nose of each firing pin does not normally project beyond the face of the breech when the hammer assembly is at rest adjacent the breech in its striking position, as it appears in full lines in FIG. 2.

Figure 3:
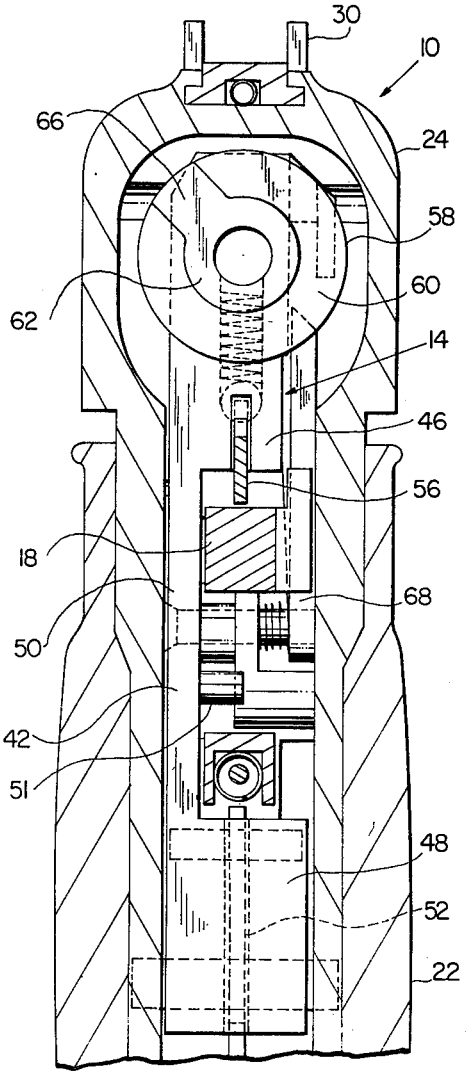
FIG. 3 is a fragmentary sectional view taken along the line 3—3 of FIG. 2.
Figure 4:
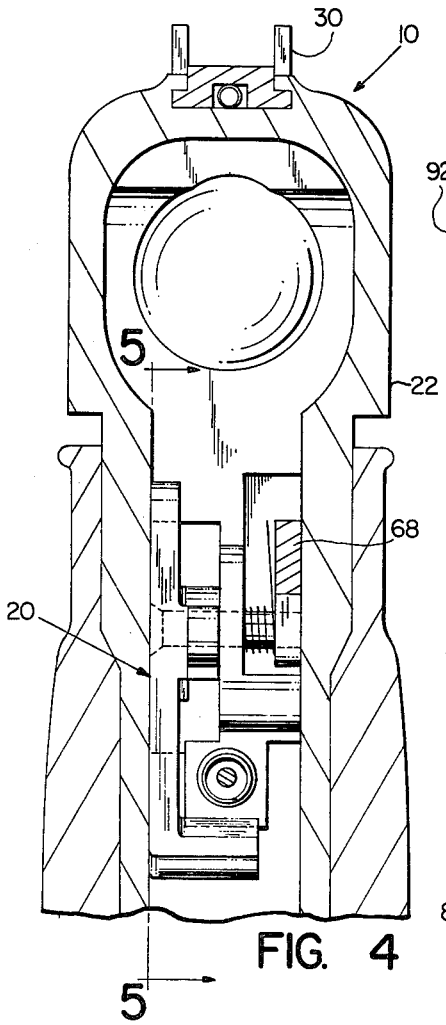
FIG. 4 is a fragmentary sectional view taken along the line 4—4 of FIG. 2.
Figure 6:
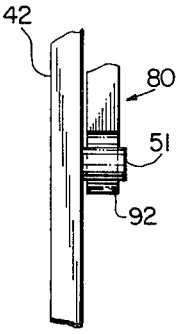
FIG. 6 is a fragmentary sectional view taken along the line 6—6 of FIG. 5.

The hammer assembly 14, shown in FIGS. 2 and 3, generally comprises an elongated hammer 42 pivotally supported at its lower ends by a pivot pin 44 which is mounted on and extends transversely of the gun frame 22. The hammer has transversely enlarged upper and lower end portions 46 and 48, best shown in FIG. 3, integrally joined by a connecting portion 50 which is disposed generally adjacent one side of the gun frame. A pin 51, mounted in fixed position on the hammer 42, projects transversely inwardly from the inner side of the connecting portion 50, as best shown in FIGS. 3 and 6. A rearwardly opening slot formed in the lower portion 48 receives the forward end of a strut 52 associated with the mainspring 16. A pin 54 mounted in fixed position in the lower portion 48 extends transversely of the slot therein and is engaged by the upper end of the strut 52, as best shown in FIG. 2.

A sear 56 pivotally supported on the hammer 42 within a downwardly opening slot in the upper portion 46 is spring biased downwardly toward a trigger engaging position by a biasing mechanism contained within the upper portion 46. The hammer assembly further includes a firing element 58 journalled for rotation on the upper end portion 46. The firing element has a generally cylindrical disc-shaped body portion 60 and an integral annular central portion 62 which projects forwardly from the body portion and which is best shown in FIG. 3. A plurality of equiangularly spaced ratchet notches 64, 64 open outwardly through the rear surface of the body portion 60. The firing element further includes a firing lug 66 which extends radially outwardly from the central portion 62, as best shown in FIG. 3. A hand or pawl 68 supported by a pivot pin 69 within the gun frame and adjacent one side thereof is spring biased in counterclockwise direction and into engagement with the rear surface of the firing element 58, as shown in FIG. 2. The pawl 68 is arranged to cooperate with the firing element 58 within the notches 64, 64 to sequentially angularly index the firing element in a counterclockwise direction about its axis, as viewed in FIG. 3, to align the firing lug 66 with an associated firing pin 38 each time the gun is fired, as will be hereinafter further discussed.

The trigger 18 is slidably supported in opposing upper and lower ways formed in the gun frame 22 for movement between a ready position shown in full lines in FIGS. 1 and 2 and a firing position indicated by broken lines in FIG. 2. The rear portion of the trigger is bifurcated and has an upwardly extending lug on its upper bifurcation which defines a forwardly facing abutment surface 70 which engages a rearwardly facing abutment on the frame 22 to limit forward travel of the trigger 18. A trigger spring assembly which includes a trigger spring 72 and a spring guide rod 74 is received within a rearwardly opening bore in the lower bifurcation and acts between the trigger 18 and the frame 22 to normally bias the trigger in forward direction toward its inactive or ready position. An upwardly opening sear notch 76 formed in the upper bifurcation is partially defined by a rearwardly facing bearing surface 77 and receives the sear 56 when the trigger is in its forward or ready position.

Figure 7:
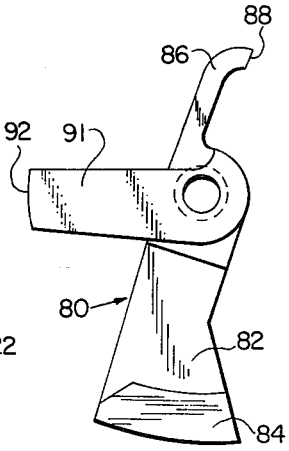
FIG. 7 is a side elevational view of the blocking element.
Figure 8:
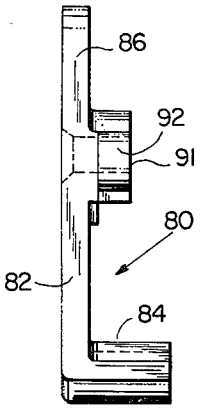
FIG. 8 is a front elevational view of the blocking element shown in FIG. 7.
Figure 5:
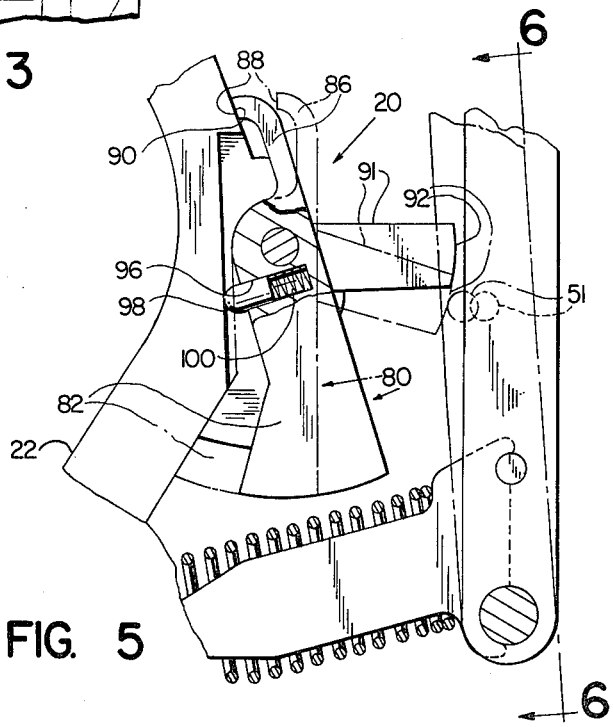
FIG. 5 is a fragmentary sectional view taken generally along the line 5—5 of FIG. 4.

Considering now the inertia responsive safety mechanism 20 and referring particularly to FIGS. 2 and 5–8, the safety mechanism essentially comprises a pendulum-like blocking element indicated generally at 80 and best shown in FIGS. 5, 7 and 8. The blocking element 80 is mounted on the gun frame 22 by the pivot pin 69 and is supported adjacent the side of the frame 22 opposite the pawl 68 for pivotal movement between inactive and active or safe positions, respectively indicated in full and broken lines in FIGS. 2 and 5. The blocking element 80 includes a depending portion 82 which carries an integral counterweight 84 at its lower end. The counterweight is arcuately contoured to complement an associated portion of the frame 22 which provides a seating surface for the trigger spring guide rod 74, as best shown in FIG. 2. The blocking member 80 further includes an integral finger 86 which extends above the pivotal axis of the member and which has a rearwardly facing abutment surface 88 at its upper end for engaging an associated abutment 90 on the gun frame, as best shown in FIGS. 2 and 5. An integral arm 91 projects radially outwardly in a forward direction from the blocking element 80 and has a forwardly facing abutment surface 92 at its forward or free end. A rearwardly opening blind bore 96, formed in the blocking element 80 immediately below its pivotal axis, receives a plunger assembly which includes a plunger 98 and a plunger spring 100, shown in FIG. 5. The plunger 98 bears against the gun frame 22 to bias the blocking element 80 in counterclockwise direction to its full line or inactive position, as viewed in FIG. 5. Engagement of the abutment surface 88 with the frame 22 limits further counterclockwise rotation of the blocking element 88 relative to the frame 22, as shown in FIG. 5. It should be noted that when the blocking element is in its inactive position of FIG. 5, the abutment surface 92 is out of blocking alignment with the pin 51 carried by the hammer. Thus, the hammer is free to pivot about the pin 44 from its striking position to its tripping position.

Referring now particularly to FIG. 2, preparatory to firing the trigger 18 is in its forward or ready position, the hammer assembly 14 is in its striking position, the firing element 58 being at rest in engagement with the breech portion 24, as it appears in full lines. The sear 56 is biased into engagement with the trigger within the sear notch 76, and the blocking element 80 is in its inactive position, as it appears in full lines in FIG. 2.

Drawing back on the trigger 18 causes the rearwardly facing bearing surface 77 to engage the forward end of the sear which lifts the hammer 42 from the breech portion and pviots it in clockwise direction toward its tripping or broken line position of FIG. 2. As the hammer assembly pivots rearwardly the pawl 68 engages an associated ratchet notch 64 to index the firing element 58 to its next successive firing position wherein the firing lug 66 is aligned in striking relation with an associated firing pin 38.

When the hammer assembly 14 reaches its tripping position, coengageable cam surfaces on the sear 56 and the trigger 18 cause the sear to escape from the sear notch 76 releasing the hammer assembly and allowing it to return to its striking position in response to biasing force of the mainspring 16. As the hammer assembly 14 reaches its striking position the firing lug 66 strikes an associated firing pin 38 imparting inertia to it and causing it to fire the primer of a cartridge seated within an associated one of the chambers 34, 34.

The recoil energy of the fired round produces a rearward thrust on the hand-held gun 10 sufficient to cause the counterweight 84 to move rearwardly thereby pivoting the blocking element 80 in counterclockwise direction about the pivot pin 69 from its inactive or full line position to its active or safe position indicated in broken lines in FIG. 2 in opposition to the relatively light biasing force exerted by the plunger spring 100 (shown in FIG. 5). When the blocking element 80 is in its safe position the abutment surface 92 is disposed in blocking relation to the pin 51. It should be noted that there is some clearance between the pin 51 and the abutment surface 92 when the blocking element is in its safe or blocking position and the hammer assembly 14 is in its striking or full position of FIG. 2. This clearance enables the blocking element to attain its safe position before the hammer assembly 14 moves a significant distance in the direction of its tripping position in opposition to the biasing force of the mainspring 16.

Under normal firing conditions rearward thrust produced by recoil will be sufficient to cause the blocking element to move to its safe position, however, the latter thrust will not ordinarily be sufficient to cause significant movement of the hammer assembly 14 from its striking position of FIG. 2 against the biasing force of the mainspring. However, in the event of an excessive propellant charge or loading density, which results in unusually great recoil, inertia imparted to the hammer assembly 14 by the rearward recoil thrust may be sufficient to lift the hammer from the breech and cause it to pivot rearwardly toward its tripping position. In the event of such occurrence the blocking element 80 will attain its safe position before any significant hammer movement occurs so that the abutment surface 92 will engage the pin 51 to arrest rearward movement of the hammer and absorb the inertia of the hammer causing the hammer to return to its normal at rest position adjacent the breech. Such hammer movement will, of course, be insufficient to index the firing lug to its next firing position so that the next successive chambered round cannot be accidentally fired.

It will now be apparent that any suddenly arrested rearward movement of the gun 10 sufficient to impart inertia to the hammer assembly 14 will also impart inertia to the blocking element 80 causing it to attain its safe or blocking position whereby to arrest rearward movement of the hammer assembly toward its tripping position to prevent accidental firing.

Further disclosure of a ratchet or firing element and pawl mechanism and a strut-mainspring mechanism, such as hereinbefore disclosed, is found in my copending U.S. Patent application Ser. No. 111,870 for Multi-Barrel Pistol, filed Jan. 14, 1980, assigned to the assignee of the present application, hereby adopted by reference as part of the present disclosure.

I claim:

1. In a double action firearm having a firing mechanism including a trigger movable between ready and firing positions, a hammer movable between tripping and striking positions, and means for moving the hammer to and releasing it in its tripping position in response to movement of the trigger from its ready to its firing position, the improvement comprising an inertia responsive safety mechanism including a blocking element, means supporting said blocking element for movement between inactive and active positions, said blocking element in its active position being disposed in blocking relation to said hammer assembly to prevent movement of said hammer assembly from its striking to its tripping position, means normally biasing said blocking element to its inactive position, and means for moving said blocking element from its inactive to its active position in response to inertial force acting on the gun and tending to move said hammer toward its tripping position.

2. In a double action firearm as set forth in claim 1 the further improvement wherein said means for moving said blocking element comprises a counterweight carried by said blocking element.

3. In a double action firearm as set forth in claim 2 the further improvement wherein said blocking element is supported for pivotal movement about an axis.

4. In a double action firearm as set forth in claim 1 the further improvement wherein said hammer is supported for pivotal movement and said blocking element is supported for pivotal movement about an axis parallel to the axis of said hammer.

5. In a double action firearm as set forth in claim 1 the further improvement wherein said means for moving said hammer comprises a sear carried by said hammer and engageable with said trigger.

6. In a double action firearm as set forth in claim 1 the further improvement wherein said biasing means comprises a spring.

7. In a double action firearm as set forth in claim 6 the further improvement wherein said biasing means includes a plunger and said spring acts between said blocking element and said plunger.

8. In a double action firearm as set forth in claim 1 the further improvement comprising a pin carried by said hammer and wherein said blocking element in its active position is disposed in the path of said pin.

9. In a multi-barrel handgun having a frame, a barrel assembly supported on the frame and including a plurality of bores, each of the bores having an associated cartridge chamber, a hammer assembly supported on the frame for movement between tripping and striking positions and including a hammer, a firing element journalled for indexible axial rotation on the hammer, and means for retaining the firing element in assembly with the hammer, first biasing means for normally urging the hammer assembly toward its striking position, a trigger supported on the frame for movement between ready and firing positions, means for moving the hammer from its striking position to its tripping position and releasing it in its tripping position in response to movement of the trigger from its ready to its firing position, and means for indexing the firing element to align it in firing relation to a cartridge seated in an associated one of the chambers in response to movement of the trigger toward its firing position, the improvement comprising an inertia responsive safety mechanism including a blocking element, means supporting said blocking element for movement between inactive and active positions, said blocking element in its active position being disposed in blocking relation to said hammer assembly to prevent movement of said hammer assembly from its striking to its tripping position, means normally biasing said blocking element to its inactive position, and means for moving said blocking element from its inactive to its active position in response to inertial force acting on the gun and tending to move said hammer toward its tripping position.

10. In a multi-barrel handgun as set forth in claim 9 the further improvement wherein said hammer is supported for pivotal movement and said blocking element is supported for pivotal movement about an axis parallel to the axis of said hammer.

11. In a multi-barrel handgun as set forth in claim 10 the further improvement wherein said means for moving said blocking element comprises a counterweight carried by said blocking element and disposed in radially spaced relation to the axis of said blocking element.

12. In a multi-barrel handgun as set forth in claim 11 the further improvement including a pin mounted on said hammer and wherein said blocking element is disposed in blocking alignment with said pin when said blocking element is in its active position.

13. In a multi-barrel handgun as set forth in any one of claims 9 through 12 wherein said means for biasing said blocking element comprises a spring acting between said blocking element and said frame.

14. In a multi-barrel handgun as set forth in any one of claims 9 through 12 wherein said means for indexing said firing element comprises a pawl supported for pivotal movement on said frame and said blocking element is supported for pivotal movement about the axis of said pawl.

* * * * *